US005192203A

United States Patent [19]

Anzawa et al.

[11] Patent Number: 5,192,203

[45] Date of Patent: Mar. 9, 1993

[54] METHOD AND APPARATUS FOR BURNING FOAMED LIQUID FUEL

[75] Inventors: Norio Anzawa; Koji Adachi, both of Muroran, Japan

[73] Assignee: Nippon Steel Corporation, Tokyo, Japan

[21] Appl. No.: 741,503

[22] PCT Filed: Mar. 15, 1991

[86] PCT No.: PCT/JP91/00353

§ 371 Date: Jul. 31, 1991

§ 102(e) Date: Jul. 31, 1991

[87] PCT Pub. No.: WO91/14900

PCT Pub. Date: Oct. 3, 1991

[30] Foreign Application Priority Data

Mar. 20, 1990 [JP] Japan ..... 2-71557
Mar. 4, 1991 [JP] Japan ..... 2-37515

[51] Int. Cl.[5] ..... F23D 11/36

[52] U.S. Cl. ..... 431/2; 431/12; 431/333; 431/335

[58] Field of Search ..... 431/2, 11, 12, 331, 431/335, 211, 333, 332; 44/639

[56] References Cited

U.S. PATENT DOCUMENTS

| | | | |
|---|---|---|---|
| 70,117 | 10/1867 | Post et al. . | |
| 1,378,689 | 5/1921 | Larson . | |
| 2,396,577 | 3/1946 | Kittel et al. | 431/240 |
| 2,710,652 | 6/1955 | Ambrose | 431/335 X |
| 4,443,180 | 4/1984 | LeFrois | 431/211 X |
| 4,566,877 | 1/1986 | Pazdej et al. | 44/280 |
| 5,051,090 | 9/1991 | Anzawa et al. | 431/335 X |
| 5,066,219 | 11/1991 | Anzawa et al. | 431/333 X |

FOREIGN PATENT DOCUMENTS

| | | | |
|---|---|---|---|
| 47-38368 | 12/1972 | Japan . | |
| 49-42018 | 11/1974 | Japan . | |
| 31256 | 3/1980 | Japan | 431/331 |
| 1-95205 | 4/1989 | Japan . | |
| 2-21106 | 1/1990 | Japan . | |
| 2-259311 | 10/1990 | Japan . | |
| 578526 | 10/1977 | U.S.S.R. . | |
| 666382 | 6/1979 | U.S.S.R. . | |
| 953256 | 3/1964 | United Kingdom . | |

*Primary Examiner*—Larry Jones
*Attorney, Agent, or Firm*—Wenderoth, Lind & Ponack

[57] ABSTRACT

A method and apparatus for high-efficiency burning of a liquid fuel such as kerosine after it has been foamed. The fuel is converted into a fine foam by supplying foaming air thereinto through a porous element having a mean pore diameter of 1–200 μm and air sufficient for ensuring complete combustion is separately supplied to a combustion chamber. The foaming air is passed through the porous element at an apparent velocity of 0.01–1 m/s. The porous element is a sintered metal body having a density of 4–6 g/cm$^3$ and a void ratio of 35–45% or a ceramic body having a density of 2.0–5.0 g/cm$^3$ and an apparent porosity of 15–45%. The method and apparatus enable ignition, prolonged continuous combustion and extinguishment to be conducted stably and with exceedingly low generation of CO, $NO_x$ and soot, and, as such are applicable to oil space heaters and industrial boilers.

15 Claims, 5 Drawing Sheets

FIG. 5
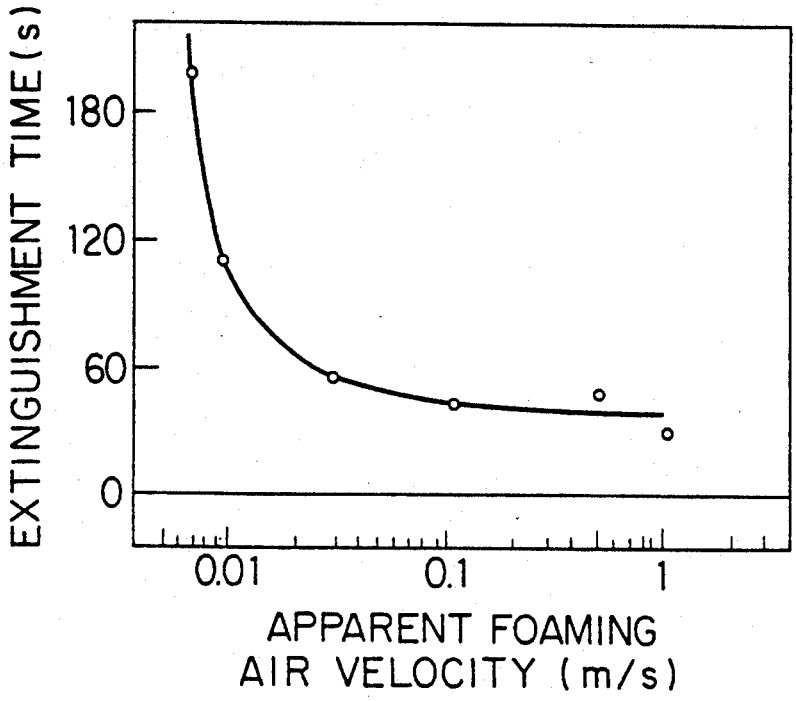
FIG. 6(a)
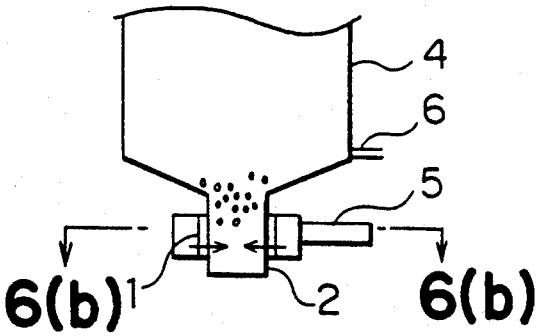
FIG. 7
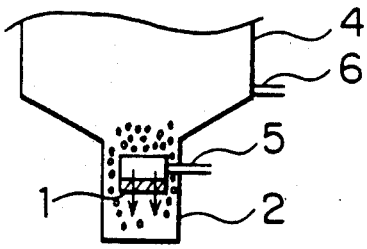
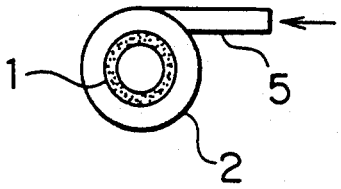
FIG. 6(b)

METHOD AND APPARATUS FOR BURNING FOAMED LIQUID FUEL

DESCRIPTION

1. Technical Field

The present invention relates to a method and apparatus for foaming and burning liquid fuel, particularly gas oils such as kerosine and light oil, in a wide range of applications from household oil stoves up to industrial furnaces.

2. Background Art

The conventional practice has been to burn a liquid fuel either directly gasified or as finely vaporized by an atomizer.

As disclosed in JP-A 1-95205, the applicant earlier proposed a completely new method of burning liquid fuel, namely a foamed fuel burning method, which expands the range over which the liquid fuel combustion rate can be regulated and overcomes the shortcomings of the pot and vaporization methods.

Further, as disclosed in JP-A 2-21106, the applicant has also proposed an apparatus for burning foamed liquid fuel in which back-flow of the fuel at the time of flame extinguishment is prevented by equipping the fuel foamer with a porous filter (element) made of a material with surface properties which give it a critical surface tension which is lower than the surface tension of the liquid fuel.

As is disclosed in JP-A 2-259311, moreover, the applicant has also proposed a method and apparatus for burning foamed liquid fuel in which a combustion chamber, a vaporization dish and a foamer are disposed close to each other, liquid fuel is supplied to the exterior of the porous element in the foamer and foaming air is supplied to the interior of the porous element, whereby the vaporization surface of the fuel is markedly increased immediately before it is burned.

Summary of the Invention

In the burning of foamed liquid fuel in the aforesaid manner, if the amount of fuel supplied is maintained constant and the amount of air supplied through the air supply pipe is increased excessively, it sometimes occurs that the fuel is converted into droplets. When this happens, the combustion becomes unstable. That is, the amount of air fed into the liquid fuel through the porous element markedly affects the foam expansion ratio of the foam and greatly affects the combustion properties of the fuel by, for example, resulting in a fuel that is not foamed but merely has bubbles dispersed therein or in a fuel that experiences the blow-through of large globs of air. Generally speaking, in the burning of foamed fuel the combustion property is affected by variation in the diameters of the bubbles constituting the foamed fuel. The mean pore diameter of the porous element constituting the fuel foamer and the apparent velocity of the foaming air (the apparent velocity calculated presuming that no porous element is present) greatly affect the stability of ignition and continuous combustion.

An object of this invention is to provide a method and apparatus for burning foamed liquid fuel wherein the uniformity and foam property of foamed fuel are stabilized, fuel vaporization is enhanced and, as a result, the stability of fuel combustion is enhanced In this specification, the term "foam" is used to mean aggregated bubbles constituted of a film of liquid fuel surrounding a gas, specifically air. The word "uniform" as termed with respect to foam is used to mean that there is little variation in the size of the bubbles constituting the foam. The term "stability of foaming" is used to mean that the diameter of the individual foam bubbles is small and the foam expansion ratio (foam volume/liquid fuel volume) is stable and large.

BRIEF DESCRIPTION OF THE DRAWINGS

FIG. 3(*b*) is a graph showing the relationship between the mean pore diameter of the porous element and the ignition stability.

FIG. 5 is a graph showing the relationship between the apparent foaming air velocity and the flame extinguishment time in an embodiment of the invention.

FIG. 6(*a*) is a vertical sectional view showing another example of the structure of the essential part of the fuel foamer used in the invention.

FIG. 6(*b*) is a sectional view taken along line B—B in FIG. 6(*a*).

FIG. 7 is a vertical section showing still another example of the structure of the fuel foamer.

BEST MODE FOR CARRYING OUT THE INVENTION

For achieving the aforesaid object, this invention provides a method for burning foamed liquid fuel by supplying foaming air to a liquid fuel through a porous element having a mean pore diameter (pore opening) of not less than 1 μm and not greater than 200 μm, thereby converting the liquid fuel into a foam constituted as an aggregation of small-diameter bubbles, and thereafter burning the foamed fuel in a combustion chamber while separately supplying thereto adequate air for complete combustion. At this time the foaming air is passed through the porous element at an apparent velocity of not less than 0.01 m/s and not more than 1 m/s.

The invention also provides an apparatus for burning foamed liquid fuel comprising a fuel foamer consisting of a porous element having a mean pore diameter of not less than 1 μm and not greater than 200 μm and an air supply pipe connected with the porous element, the fuel foamer defining a foaming zone, and a combustion chamber disposed immediately above the fuel foamer and adapted for supplying combustion air to foamed fuel, the combustion chamber defining a combustion zone. The porous element is, as required, constituted as a sintered metal body having a density of 4.0–6.0 g/cm$^3$ and an apparent porosity of 35–45% or as a ceramic body having a density of 2.0–5.0 g/cm$^3$ and an apparent porosity of 15–45%. As found necessary, the porous element is disposed with its pore openings oriented horizontally to prevent its foaming capability from being degraded by soot or scale or is disposed with its pore openings oriented downward for the same purpose.

The invention will now be explained with reference to the drawings.

Figure 1:
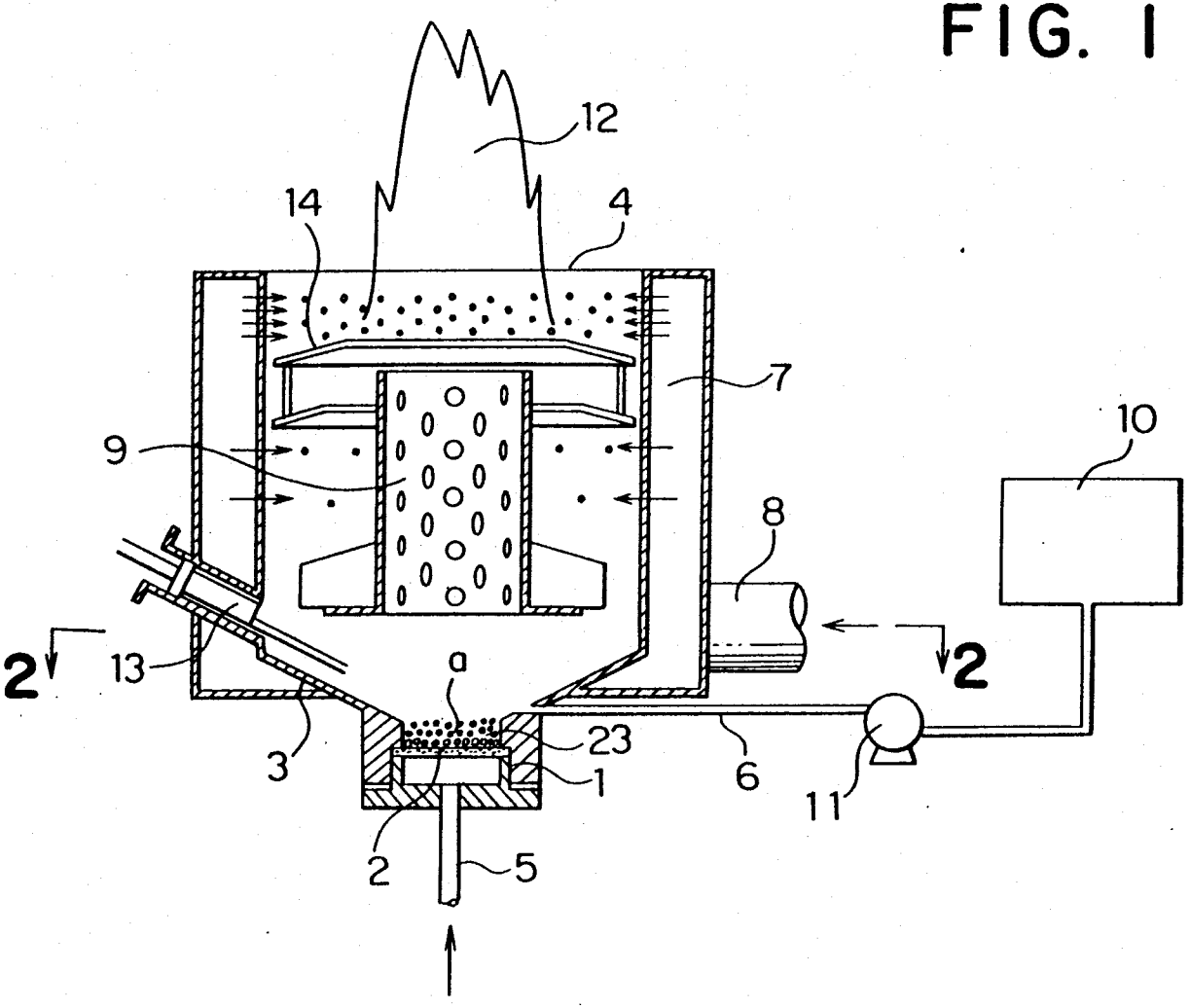
FIG. 1 is a vertical sectional view of the essential part of an embodiment of the apparatus according to the invention.
Figure 2:
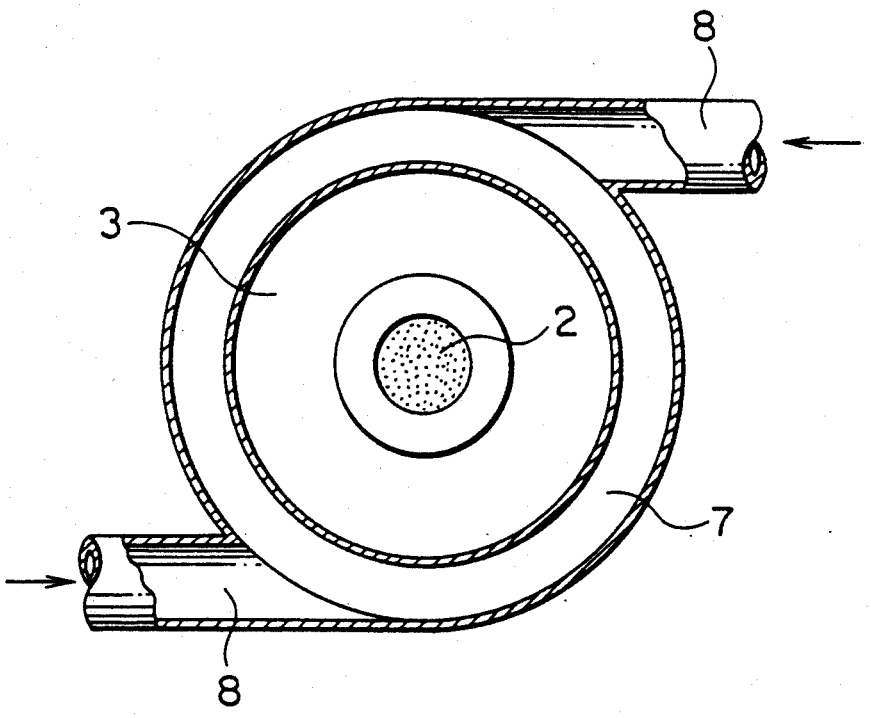
FIG. 2 is a sectional view of the same embodiment taken along line A—A in FIG. 1.

An embodiment of the apparatus according to the present invention is illustrated in FIG. 1 and a sectional view of this embodiment taken along line A—A in FIG. 1 is shown in FIG. 2. In these figures, reference numeral 1 designates a fuel foamer, 2 a porous element, 3 a vaporization dish and 4 a combustion chamber. The vaporization dish 3 is located immediately beneath the combustion chamber 4 and the fuel foamer 1 immediately beneath the vaporization dish 3. These three members are thus disposed continuously and in close proximity.

The combustion chamber 4 situated above the vaporization dish 3 is surrounded by a wind box 7 connected with a combustion air supply pipe 8 for supplying combustion air from the exterior. The liquid fuel is supplied to the top of the porous element 2 installed inside the fuel foamer 1. However, since a gas, typically air, is supplied from a foaming air supply pipe 5 beneath the porous element 2 from before the start of the supply of the liquid fuel to the top thereof, the fuel (kerosine, light oil or the like) is immediately converted into a foam consisting of an aggregate of small diameter bubbles.

This foam is directly ignited by an ignition heater 13 and the fuel burns continuously thereafter. Although kerosine is generally used as the liquid fuel, it is also possible to use light oil. In either case, the liquid fuel is supplied from a fuel tank 10 via a pump 11 and a fuel supply pipe 6. Inside the combustion chamber 4 there is provided a flame stabilizer 9 and a ring 14 which cooperate to stabilize the continuous combustion. The reference numeral 12 designates a flame. The fuel foamer 1 is located below the center of the vaporization dish 3. The porous element 2 within the fuel foamer 1 is disposed beneath a recess 23 formed below the floor of the vaporization dish 3. In the embodiment illustrated in FIG. 1, the foaming air supply pipe 5 is connected with the porous element 2 at the bottom thereof. As a result of the foregoing arrangement there is defined a foaming zone a. The porous element 2 plays a very important role in stabilizing the uniformity and foam property of the foamed fuel and, in view of this, this invention defines the mean porosity (pore opening) diameter of the porous element to be not less than 1 μm and not greater than 200 μm.

Figure 3A:
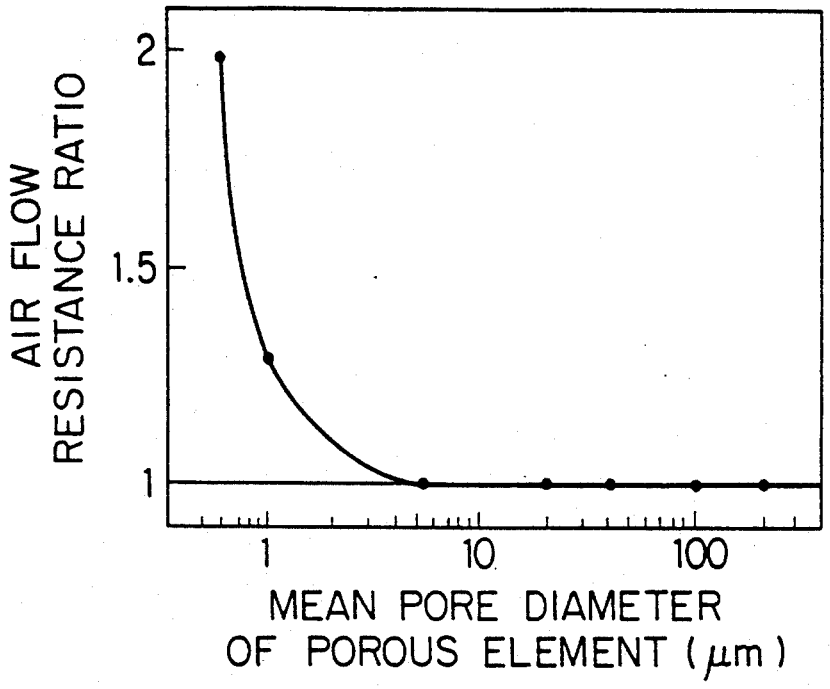
FIG. 3(*a*) is a graph showing the relationship between the mean pore diameter and the air resistance of the porous element used in this invention.
Figure 3B:
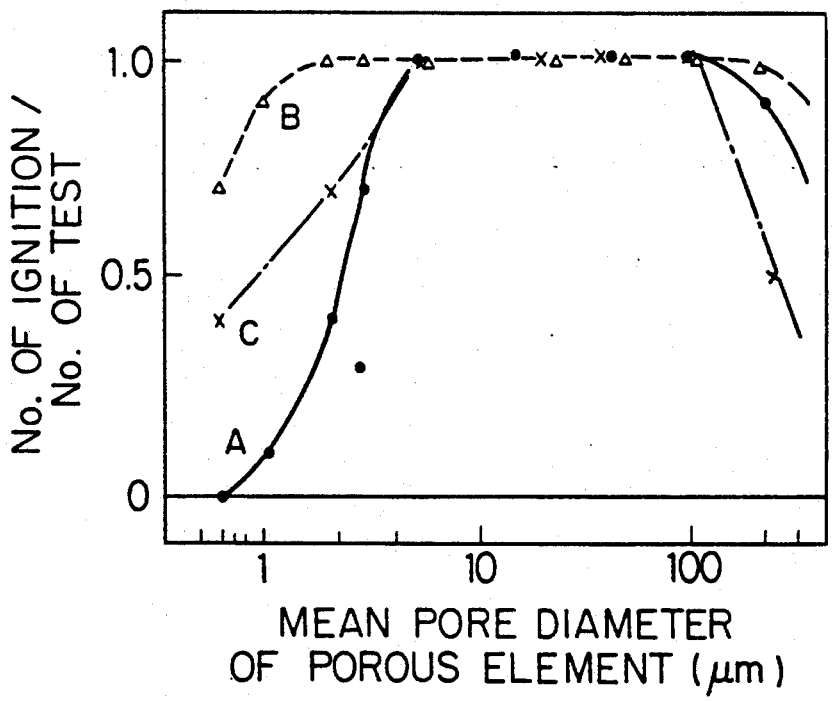

FIG. 3(*a*) shows the relationship between mean pore diameter and pressure loss determined through an ignition-extinguishment test while FIG. 3(*b*) shows the relationship between mean pore diameter and ignition failure. Both graphs are based on data obtained in tests conducted by the inventors.

More specifically, the air flow resistance ratio indicated in FIG. 3(*a*) is the pressure loss at the 1000th ignition divided by the pressure loss at the first ignition. In FIG. 3(*b*), curves A, B and C respectively indicate the results at apparent foaming air velocities of 0.01 m/s, 0.1 m/s and 1.0 m/s.

These test results show that when the mean pore diameter of the porous element is less than 1 μm, not only does the flow resistance to the foaming air increase markedly but the element pores eventually clog. On the other hand, when the mean pore diameter exceeds 200 μm, the diameters of the bubbles constituting the foam become large throughout, which leads to blow-through of the supplied air and makes it impossible to obtain a stable foam.

Tests conducted by the inventors also showed that the foam expansion ratio, an index of the foaming state, has to be at least 5 times in order to obtain a foam with an increased contact area between the fuel and air sufficient for realizing an amount of fuel vaporization that is within the range in which ignition and combustion are possible. As can be seen from FIG. 4, however, even when the mean pore diameter of the porous element is appropriate, the foam expansion ratio varies with the type and temperature of the fuel. In this invention, therefore, the apparent velocity of the foaming air passing through the porous element is selected within the range of 0.01 m/s–1 m/s.

Figure 4:
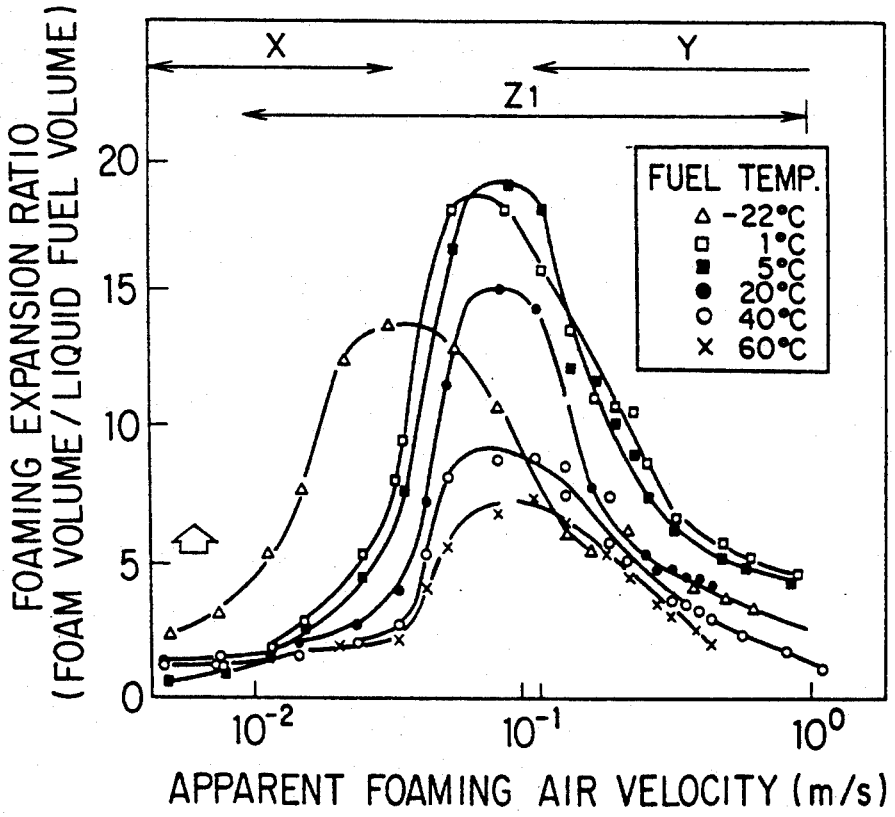
FIG. 4 is a graph showing the relationship between the apparent foaming air velocity and the foam expansion ratio in this invention.

This is because, notwithstanding that the situation differs somewhat depending on the temperature of the fuel, an apparent foaming air velocity of less than 0.01 m/s results in most of the bubbles remaining in the liquid fuel in a separated state, namely in a foamed state falling within the bubble separation region indicated by X in FIG. 4. When an ordinary fuel is used at an ordinary temperature, therefore, the amount of fuel vaporization is too low to enable ignition and continuous combustion. On the other hand, at an apparent foaming air velocity greater than 1 m/s large globs of gas blow through the liquid fuel and make stable foam formation impossible. Both ignition and continuous combustion become unstable.

The porous element used to obtain the data presented in FIG. 4 was made of sintered metal and had 40 μm pore openings. In the figure, X indicates the bubble separation region, Y a bubble slag region, $Z_1$ a bubble aggregation region (appropriate foaming) and $Z_2$ an appropriate foaming region.

The structure of a porous element enabling the method of this invention to be carried out will now be explained. Among the materials which can be used for fabricating a porous element with a mean pore diameter of not less than 1 μm and not greater than 200 μm there can be mentioned porous sintered metal and porous ceramic.

Where a sintered metal is used for the porous element, it is preferable to select a sintered body with a density of 4.0–6.0 g/cm$^3$ and an apparent void ratio of 35–45%, and where a ceramic is used, it is preferable to select a ceramic body with a density of 2.0–5.0 g/cm$^3$ and an apparent porosity of 15–45%.

Other tests conducted by the inventors revealed that the adverse effect on the porous element 2 of the soot that forms owing to the burning of the fuel and the scales that fall from the flame stabilizer can be prevented by constituting the fuel foamer so that the pore openings of the porous element 2 are oriented horizontally as shown in FIG. 6 or downward as shown in FIG. 7.

Specifically, in the arrangement shown in FIG. 6, the porous element 2 is formed to be ring shaped and the foaming air is supplied tangentially thereto from the foaming air supply pipe 5.

Both this arrangement and the one illustrated in FIG. 7 prevent accretion on the porous element of soot produced by fuel combustion and scales from the flame stabilizer. They thus ensure stable ignition and continuous combustion.

While the fuel foamer, the vaporization dish and the combustion chamber of the invention are shown as being circular in plan view, the invention is not limited to this shape and these members can alternatively be square, rectangular or of some other configuration.

Whatever the shape of these members, the arrangement according the invention makes it easily possible to boost the combustion rate by (a) increasing the amount of foaming air supplied through the foaming air supply pipe 5 into the fuel supplied from the fuel supply pipe 6 in order to increase the amount of foam produced, while (b) simultaneously increasing the amount of combustion air supplied through the combustion air supply pipe 8. The invention thus enables the combustion rate to be controlled over a broad range.

EXAMPLES

Employing an apparatus of the structure illustrated in FIG. 1, combustion tests were conducted under various conditions, some falling within the scope of the invention and others falling outside thereof.

The dimensional specifications of the combustion chamber and fuel foamer used in the tests were as follows:

| | |
|---|---|
| Combustion chamber | |
| Inside diameter | 150 mm |
| Height | 150 mm |
| Fuel foamer | |
| Inside diameter | 40 mm |
| Height | 20 mm |
| Porous element (sintered metal or ceramic body) | |
| Diameter | 40 mm |
| Thickness | 2 mm |
| Inverted conical vaporization dish | |
| Upper periphery diameter | 150 mm |
| Base diameter | 40 mm |
| Flame stabilizer | w/combustion ring |

Two types of tests were conducted. The first was a continuous combustion test in which test cycles each consisting of 48 hours of continuous combustion following ignition were repeated over a prolonged period of time. The other was an ignition test involving repeated ignition-extinguishment cycles each consisting of 30 minutes of combustion following ignition, extinguishment and a 15-minute rest period.

In the prolonged continuous test, a prescribed amount of combustion air was supplied to the combustion chamber 4 through the combustion air supply pipe 8, a prescribed amount of foaming air was continuously supplied to the porous element 2 (diameter, 40 mm) through the foaming air supply pipe 5, and a prescribed amount of kerosine was simultaneously supplied via the pump 11 to the top of the porous element 2 disposed inside the fuel foamer 1. The kerosine was immediately converted into foam and ignited by the ignition heater 13. After about 2 minutes the air supply and combustion rates were adjusted to prescribed levels, whereafter the fuel burned continuously. After the combustion had reached a normal state, measurements were conducted once every 4 hours to determine the amounts of CO, $NO_x$, BR (soot) and aldehyde in the exhaust gas. The results for the invention are shown in Table 1 together with those for comparative examples.

TABLE 1

| Test No. | Kerosine consumption (l/hr) | Element: Pore opening (μm) | Element: Material | Element: Density (g/cm³) | Element: Porosity (%) | Apparent velocity (m/s) | Combustion characteristics (4-hr average): CO (ppm) | BR | $NO_X$ $O_2$; 0% | Aldehyde (ppm) | Remarks |
|---|---|---|---|---|---|---|---|---|---|---|---|
| 1 | 1.5 | 1 | SUS | 4.8 | 38.6 | 0.5 | 10 | 0 | 50 | 0 | Invention |
| 2 | 1.5 | 10 | SUS | 4.6 | 39.0 | 0.5 | 0 | 0 | 40 | 0 | Invention |
| 3 | 1.0 | 40 | SUS | 4.5 | 40.0 | 0.01 | 20 | 1 | 55 | 0 | Invention |
| 4 | 1.5 | 40 | SUS | 4.5 | 40.0 | 0.5 | 0 | 0 | 40 | 0 | Invention |
| 5 | 1.5 | 40 | SUS | 4.5 | 40.0 | 1.0 | 5 | 0 | 50 | 0 | Invention |
| 6 | 1.5 | 100 | SUS | 4.4 | 41.5 | 0.5 | 0 | 0 | 40 | 0 | Invention |
| 7 | 1.5 | 150 | SUS | 4.3 | 42.0 | 0.5 | 0 | 0 | 40 | 0 | Invention |
| 8 | 1.0 | 30 | $Al_2O_3$ | 3.9 | 21.3 | 0.01 | 20 | 1 | 45 | 0 | Invention |
| 9 | 1.5 | 30 | $Al_2O_3$ | 3.9 | 21.3 | 0.5 | 5 | 0 | 35 | 0 | Invention |
| 10 | 2.0 | 30 | $Al_2O_3$ | 3.9 | 21.3 | 1.0 | 5 | 0 | 50 | 0 | Invention |
| 11 | 1.5 | 70 | $Al_2O_3$ | 3.9 | 29.9 | 0.5 | 0 | 0 | 40 | 0 | Invention |
| 12 | 1.5 | 0.4 | SUS | 4.8 | 38.6 | 0.01 | 80 | 1 | 65 | 15 | Comparison |
| 13 | 1.5 | 100 | SUS | 4.4 | 41.5 | 2.5 | 150 | 3 | 90 | 20 | Comparison |
| 14 | 2.0 | 0.6 | $Al_2O_3$ | 4.0 | 22.6 | 0.01 | 70 | 1 | 70 | 10 | Comparison |
| 15 | 2.0 | 100 | $Al_2O_3$ | 3.9 | 30.0 | 2.5 | 200 | 3 | 100 | 20 | Comparison |

As shown in Table 1, good combustion characteristics were obtained in all of the tests conducted according to the invention. These excellent results show that the burning of the foamed fuel not merely enhanced the vaporization of the fuel but also greatly improved the degree of mixing of the vaporized fuel with the combustion air.

Table 2 also shows the combustion characteristics obtained with various combinations of porous element mean pore diameter (pore opening) and apparent foaming air velocity. The results verify the superior effect of using a porous element mean pore diameter and an apparent foaming air velocity within the ranges prescribed by the invention.

As indicated by the comparative examples shown in Table 1, an optimum combustion state could not be obtained even when the mean pore diameter (pore opening) of the porous element was within the range of the invention insofar as the apparent foaming air velocity was outside the range of the invention.

TABLE 2

| Mean pore $\phi$ (pore opening) | Apparent foaming air velocity at element (m/s): 0 | 0.01 | 0.1 | 0.5 | 1.0 | 2.0 |
|---|---|---|---|---|---|---|
| 1 μm | NG | Poor | Fair | Fair | Poor | NG |
| 10 | NG | Poor | Good | Good | Fair | NG |
| 40 | NG | Fair | Good | Good | Fair | NG |
| 100 | NG | Poor | Good | Good | Fair | NG |
| 200 | NG | Poor | Fair | Fair | Poor | NG |

Evaluation criteria (values measured once per 4 hours)

Good: CO, BR both zero — Poor: Co 50–110 ppm, BR 1–2

Fair: CO < 50 ppm, BR < 1 — NG: CO > 100 ppm, BR > 2

The apparent foaming air velocity at the porous element has a pronounced effect on the ignition stability when the mean pore diameter is near the limit value. As shown in Table 2, it also affects the amount of CO, $NO_x$ and BR (soot) in the exhaust gas and, as shown in FIG. 5, further influences the extinguishment time. FIG. 5 is based on the results of tests using a porous element with a mean pore diameter of 40 μm.

In all of the combustion tests conducted, the optimum apparent foaming air velocity at the porous element section was found to be in the range of 0.01–1 m/s.

Industrial Applicability

Since the invention prescribes an optimum mean pore diameter for the porous element used in the fuel foamer, the resistance offered to the flow of foaming air is minimized. Moreover, by limiting the apparent foaming air velocity at the porous element section, the invention ensures that the foamed fuel will consist of an aggregate of small bubbles with diameters in the range of 0.5–5 mm, whereby it is possible to achieve stable ignition and continuous combustion. The invention thus has high industrial utility.

We claim:

1. A method for burning foamed liquid fuel by supplying foaming air to a liquid fuel through a porous element having a mean pore diameter of not less than 1 μm and not greater than 200 μm, thereby converting the liquid fuel into a foam constituted as an aggregation of small-diameter bubbles, and thereafter burning the foamed fuel in a combustion chamber while separately supplying thereto adequate air for complete combustion.

2. A method for burning foamed liquid fuel according to claim 1, wherein the foaming air is passed through the porous element at an apparent velocity of not less than 0.01 m/s and not more than 1 m/s.

3. An apparatus for burning foamed liquid fuel comprising a fuel foamer including a porous element having a mean pore diameter of not less than 1 μm and not greater than 200 μm and an air supply pipe connected with the porous element, the fuel foamer defining a foaming zone, and a combustion chamber disposed immediately above the fuel foamer and adapted for supplying combustion air to the foamed fuel, the combustion chamber defining a combustion zone.

4. The apparatus for burning foamed liquid fuel according to claim 3, wherein the porous element comprises a sintered metal body having a density of 4.0–6.0 g/cm$^3$ and an apparent porosity of 35–45%.

5. The apparatus for burning foamed liquid fuel according to claim 3, wherein the porous element is constituted as a ceramic body having a density of 2.0–5.0 g/cm$^3$ and an apparent porosity of 15–45%.

6. The apparatus for burning foamed liquid fuel according to claim 3, wherein the porous element is disposed with its pore openings oriented horizontally to prevent its foaming capability from being degraded by soot or scale.

7. The apparatus for burning foamed liquid fuel according to claim 6, wherein the porous element is ring shaped.

8. The apparatus for burning foamed liquid fuel according to claim 3, wherein the porous element is disposed with its pore openings oriented downward to prevent its foaming capability from being degraded by soot or scale.

9. A method for burning foamed liquid fuel, comprising the steps of:

supplying foaming air having an apparent velocity of not less than 0.1 m/s and not more than 1 m/s through a porous element having a mean pore diameter of not less than 1 μm and not greater than 200 μm, said supplying of foaming air occurring from below the porous element; and supplying liquid fuel to a position above the porous element to thereby produce foamed liquid fuel constituted by an aggregation of bubbles.

10. An apparatus for burning foamed liquid fuel, comprising:

a fuel foamer comprising a porous element having a mean pore diameter of not less than 1 μm and not greater than 200 μm;

a foaming air supply pipe connected with said porous element to supply foaming air therethrough;

a combustion chamber disposed immediately above said fuel foamer; and a combustion air supply pipe connected into said combustion chamber.

11. An apparatus as recited in claim 10, wherein said porous element is disposed with its pores oriented horizontally.

12. An apparatus as recited in claim 10, wherein said porous element is disposed with its pores oriented downwardly.

13. An apparatus as recited in claim 10, wherein said porous element is ring-shaped.

14. An apparatus as recited in claim 10, wherein said porous element comprises a sintered metal body having a density of 4.0–6.0 g/cm$^3$ and an apparent porosity of 35–45%.

15. An apparatus as recited in claim 10, wherein said porous element comprises a ceramic body wherein a density of 2.0–5.0 g/cm$^3$ and an apparent porosity of 15–45%.

* * * * *